US006672474B2

(12) United States Patent
May et al.

(10) Patent No.: US 6,672,474 B2
(45) Date of Patent: Jan. 6, 2004

(54) COMBINATION TISSUE DISPENSER AND WASTE COLLECTOR

(76) Inventors: Robert C. May, 1584 Bellmonte Rd., Pittsburgh, PA (US) 15237; Christopher S Ayers, 242 Village Blvd. #2305, Tequesta, FL (US) 33469

( * ) Notice: Subject to any disclaimer, the term of this patent is extended or adjusted under 35 U.S.C. 154(b) by 66 days.

(21) Appl. No.: 10/118,189

(22) Filed: Apr. 8, 2002

(65) Prior Publication Data

US 2003/0189059 A1 Oct. 9, 2003

(51) Int. Cl.[7] ..... B65H 1/00
(52) U.S. Cl. ..... 221/34; 221/102
(58) Field of Search ..... 221/33, 34, 45, 221/46, 102, 97, 99, 101; 206/494, 459, 233

(56) References Cited

U.S. PATENT DOCUMENTS 2,345,309 A 3/1944 Wensel, Jr.
2,841,276 A 7/1958 Schwimmer et al.
3,245,580 A * 4/1966 Campanella ..... 221/34
3,270,938 A * 9/1966 Rhinegold ..... 229/101
4,519,308 A 5/1985 Eberle
4,919,302 A 4/1990 McPherson
5,054,612 A 10/1991 Meyer, Jr.
5,129,545 A 7/1992 Parks

* cited by examiner

*Primary Examiner*—Kenneth W. Noland
(74) *Attorney, Agent, or Firm*—McKay & Associates, P.C.

(57) ABSTRACT

A combination tissue dispenser and waste collector for dispensing clean tissues or towels and collecting and compacting the waste material. The tissue dispenser and waste collector comprises two compartments, one for dispensing clean tissues or towels and the other for receiving the compacted waste paper. The dispenser slides within the waste collector compartment, thus compacting the waste paper. The two compartments remain attached during use by the abutment of stops on the sides thereof.

12 Claims, 3 Drawing Sheets

COMBINATION TISSUE DISPENSER AND WASTE COLLECTOR

FIELD OF THE INVENTION

The invention relates generally to a tissue paper dispenser and combined waste collector, and more particularly to a tissue dispenser and waste collector defining two compartments that are removably attached and slidably engagable with one another. The tissue dispenser compartment slides within the waste collector compartment to compact the tissues in the waste collector compartment to provide for a convenient waste disposal location and longer use before emptying.

DESCRIPTION OF RELATED ART

Tissue dispenser/trash collectors are known in the art. U.S. Pat. No. 2,345,309 to Wensel, Jr. discloses a tissue dispenser/trash collector, which fits into the pockets of a coat or a sweater. The collector is rigidly connected to the dispenser and opens in an accordion like fashion. U.S. Pat. No. 4,919,302 to McPherson also discloses a tissue dispenser/trash collector, which comprises two compartments that are integrally connected. The waste collection compartment in McPherson opens and closes in an according-like fashion. However, some drawbacks exist in that (1) they must be inverted and shaken to remove the waste tissue material from the collector, and (2) both collectors are open to the air, and thus they could contaminate the surrounding environment.

Further, tissue dispenser/trash collectors that have two compartments that are capable of separation are known in the art. U.S. Pat. No. 5,054,612 to Meyer, Jr. discloses a tissue dispenser/trash collector with two compartments that can become separated in order to replace the waste filled compartment. Here, the prior art lacks a compacting means.

U.S. Pat. No. 2,841,276 to Schwimmer et al. discloses a tissue dispenser/trash collector which provides for tissue waste to be stored in an accordion-like compartment located directly under the dispenser section. The waste compartment may separate partially from the dispenser to enable tissue waste removal.

U.S. Pat. No. 5,129,545 to Parks describes a tissue dispenser/trash collector with one compartment separated into two sections by a flexible bag. In this invention, clean tissues are taken from the top opening of the compartment, used, and then pushed through an entry hole in the bottom of the compartment, where the waste is collected.

U.S. Pat. No. 4,519,308 to Eberle discloses a tissue dispenser/trash collector for towels. It comprises two compartments, one for holding the paper towels and one for holding the waste tissue material. Drawbacks exist in as much as the compartments are rigidly connected and are not slidably engagable with one another.

There is a need then in the art of tissue dispenser/trash collectors for an invention that can compact waste paper tissues and keep germs from contaminating the surrounding air. Compacting the tissues will lessen the frequency of emptying these trash collectors. It will also provide more compacted paper waste and will reduce the service person's or homemaker's workload.

SUMMARY OF THE INVENTION

It is an object of the present invention to provide a waste collector compartment removably attached to a dispensing compartment for easy access to and disposal of towels or tissues.

It is yet another object of the present invention to provide a waste collector that can be compacted and emptied once it is full and then reused.

It is further an object of the present invention to provide a mirror attached to the dispensing compartment's flip cover to enable a user to view any self-removal of make-up or the like.

Accordingly, what is provided is a tissue dispenser and waste collector. The tissue dispenser and waste collector comprises a hollow, generally rectangular dispenser having a top, a sliding face, and two opposing outer side-walls. It also includes a hollow generally rectangular waste collector having a top, a back face, a front opening and two inner side-walls. The dispenser is slidably engagable within the waste collector to enable the compacting of waste paper using the sliding face. A pair of dispenser stops are located on each outer side-wall, proximate to the sliding face. A pair of waste collector stops are located on each inner side-wall, proximate to the front opening. The dispenser stops and waste collector stops in combination enable the dispenser to remain attached to the waste collector after such compacting. The tissue dispenser also includes a flip cover attached to the dispenser top and a mirror attached to an underside of the flip cover.

The tissue dispenser and waste collector can be disposable or preferably reusable. Both compartments are made of a semi-rigid material and preferably made of cardboard, or a plastic material.

DETAILED DESCRIPTION OF THE PREFERRED EMBODIMENT

The invention will now be described in detail in relation to a preferred embodiment and implementation thereof which is exemplary in nature and descriptively specific as disclosed. As is customary, it will be understood that no limitation of the scope of the invention is thereby intended, and that the invention encompasses such alterations and further modifications in the illustrated device, and such further applications of the principles of the invention illustrated herein, as would normally occur to persons skilled in the art to which the invention pertains.

Figure 1:
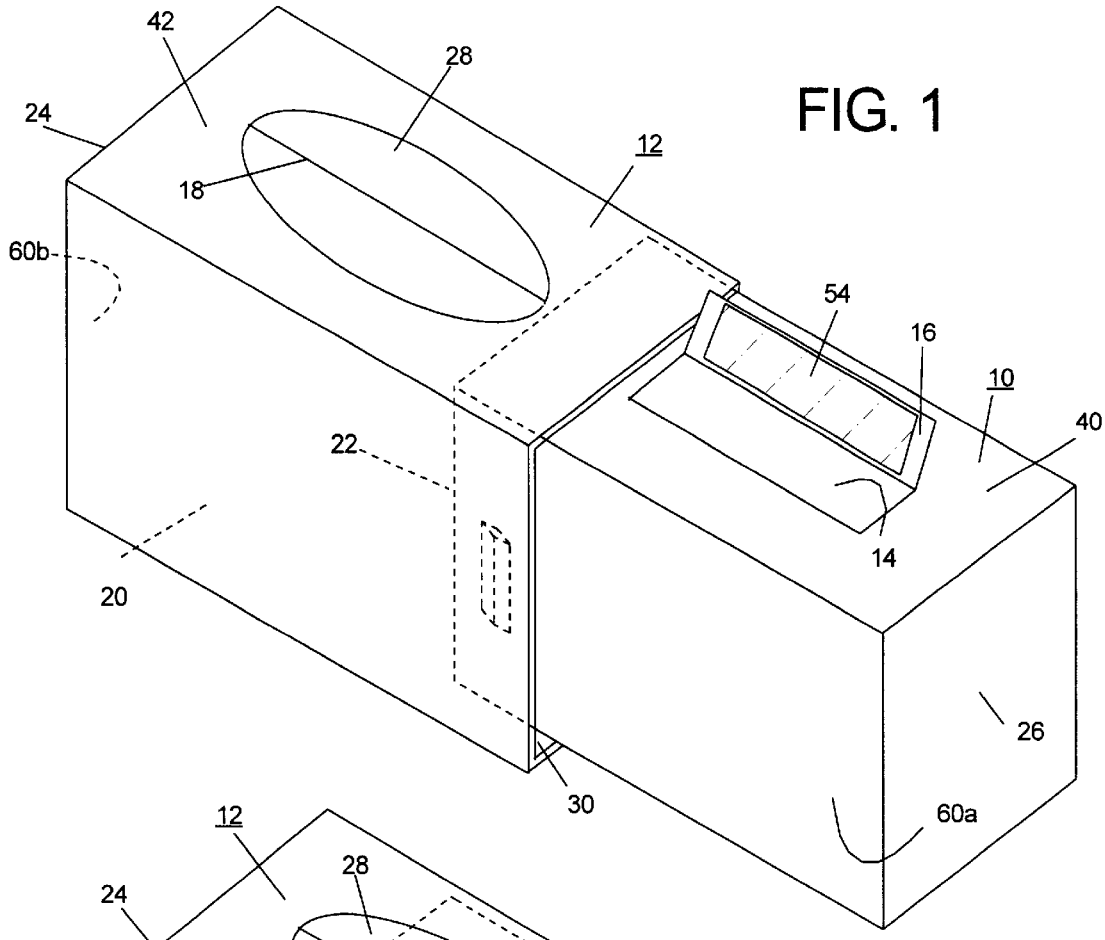
FIG. 1 is a perspective view of the tissue dispenser and waste collector in a non-compacted position.
Figure 2:
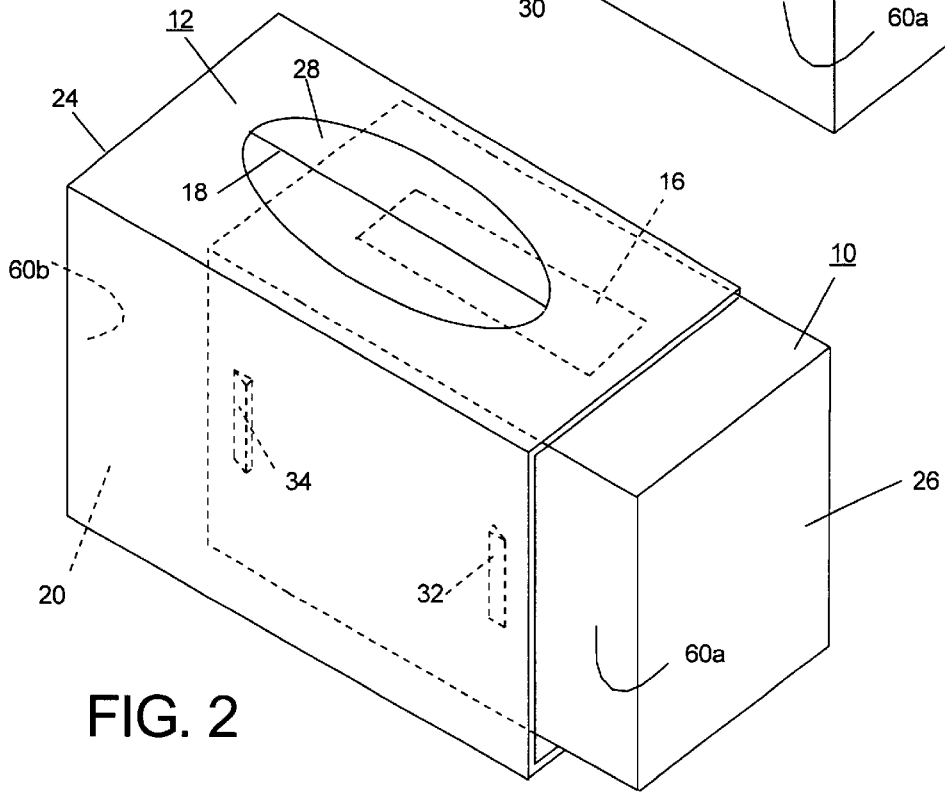
FIG. 2 is a perspective view of the tissue dispenser and waste collector in a compacted position.
Figure 3:
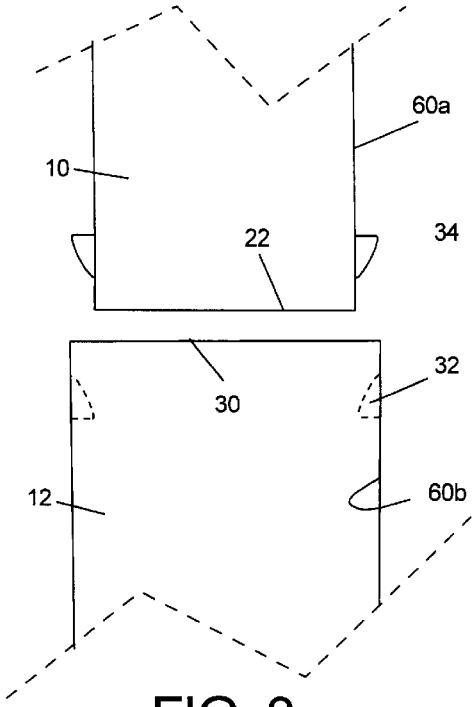
FIG. 3 is a top view of the tissue dispenser and waste collector showing the connection means between the two compartments.
Figure 4:
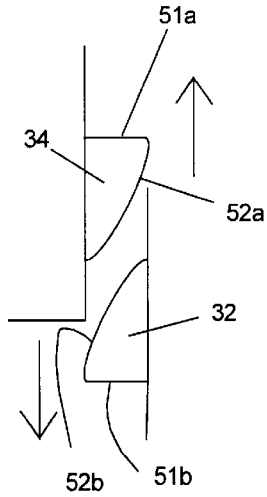
FIG. 4 is an enlarged view of the connection means between the two compartments in an open position.
Figure 5:
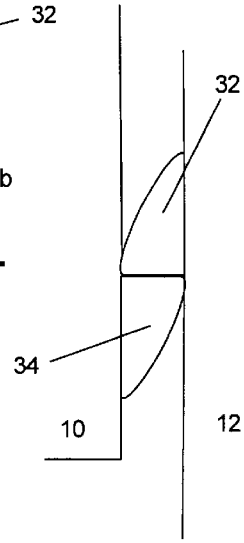
FIG. 5 is an enlarged view of the connection means between the two compartments in a closed position.
Figure 6:
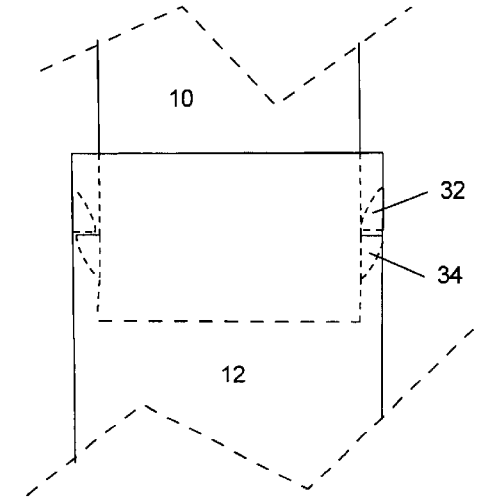
FIG. 6 is a top view of the tissue dispenser and waste collector in the closed position.
Figure 7:
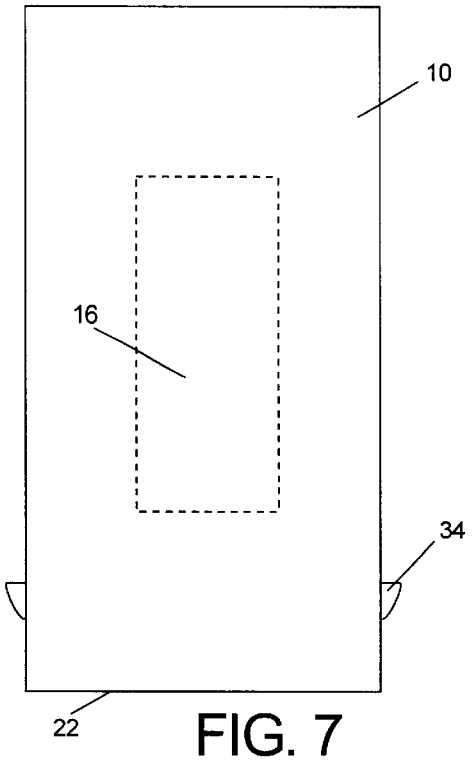
FIG. 7 is a top view of the tissue dispenser compartment.
Figure 8:
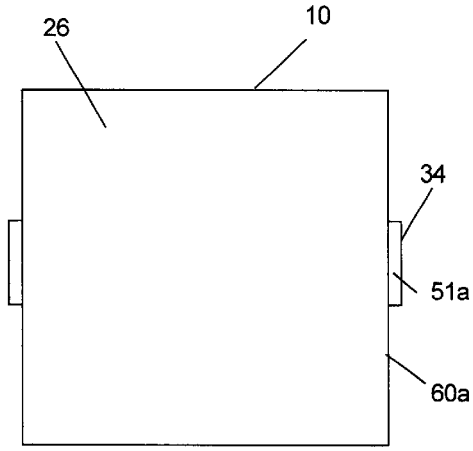
FIG. 8 is a front view of the tissue dispenser compartment.
Figure 9:
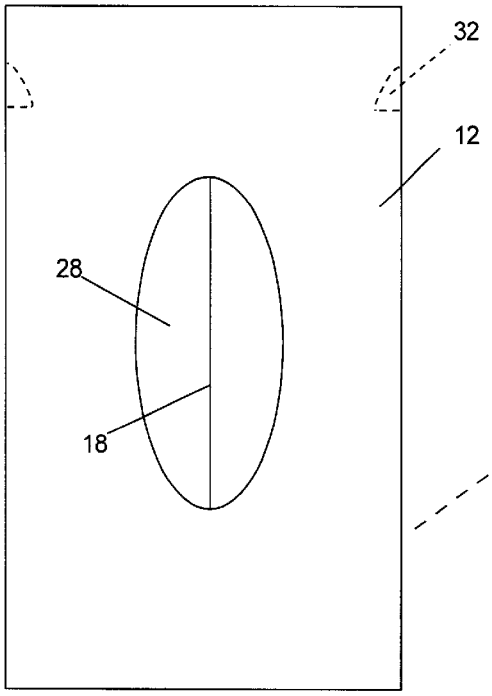
FIG. 9 is a top view of the waste collector compartment.
Figure 10:
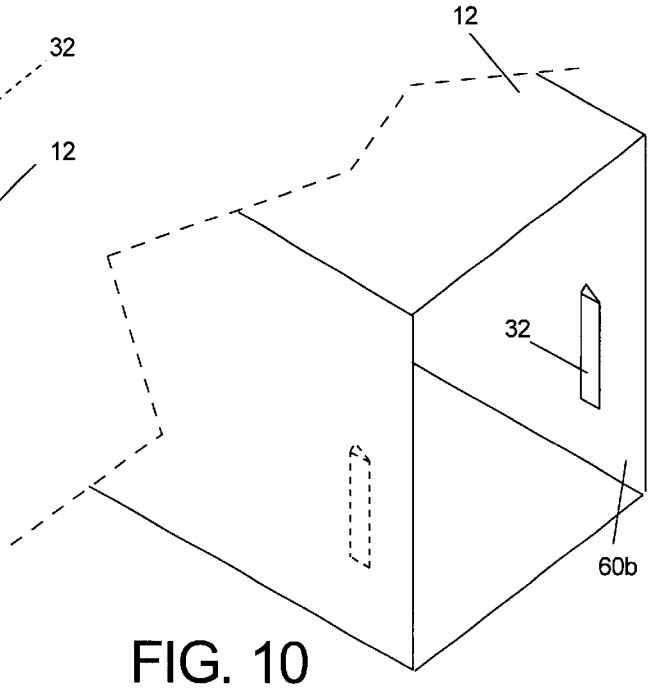
FIG. 10 is a perspective view of the waste collector compartment showing the waste collector stops mounted on the inner side-wall.

Referring now to FIGS. 1 and 2, the present invention comprises a waste collector 12 and a tissue dispenser 10. The waste collector 12 and the tissue dispenser 10 are removably attached and slidably engaged to one another. A pair of opposing stops 32 and 34 each assure attachment during use. Both the waste collector 12 and the tissue dispenser 10 can be made of cardboard, plastic, or any other similar material. The present invention provides for the tissue dispenser 10 to be able to slide within the waste collector 12, thereby compacting waste paper 20 disposed therein. When full, the waste collector 12 can be either disposed of and replaced or emptied and reused.

The waste collector 12 comprises two inner side-walls 60*b*, a front 30, which is engaged with the dispenser, and a back face 24, which serves as the structure against which the waste paper is compacted. The waste collector 12 also includes a waste collector top 42. The waste collector top 42 encompasses a waste entryway 18, which can be circular, semi-circular, square, rectangular, triangular, or any other similar shape. This waste entryway 18 provides an opening through which tissues or towels are deposited after use. The waste entryway 18 includes a plastic, paper, or cardboard cover 28 over the opening to prevent germs from dispersing from the waste paper into the surrounding atmosphere.

In FIG. 2 the compacting motion is shown. The tissue dispenser 10 is pushed towards the back face 24 of waste collector 12, compacting the waste paper 20, as the waste collector 12 is filled. The compacting motion will be accomplished by the user applying a light pressure to the front face 26 and the back face 24 of the tissue dispenser 10 and waste collector 12.

The tissue dispenser 10 is filled with tissues or towels or similar items and includes a front face 26, a dispenser top 40. The dispenser top 40 comprises an opening 14, through which tissues are retrieved. The opening 14 is covered, when not in use, by a flip cover 16. The flip cover 16 includes a mirror 54 on its underside. The flip cover 16 can be opened during use into a substantially vertical position, whereby the flip cover 16 is substantially perpendicular to the tissue dispenser top 40. The mirror 54 enables the user to apply or wipe off makeup or the like while using the tissue dispenser 10 and waste collector 12.

The connection means between the waste collector 12 and the tissue dispenser 10 include two waste collector stops 32 and two dispenser stops 34. These stops 32 and 34 provide for the removable attachment of the waste collector 12 from the tissue dispenser 10. Stops 32 and 34 are mounted to the side-walls 60*a* and 60*b*. As shown in FIGS. 3–10, the dispenser stops 34 are mounted to the outer side-wall 60*a* of the tissue dispenser 10. The waste collector stops 32 are mounted to the internal side-wall 60*b* of the waste collector 12.

Referring to FIGS. 3–6, the stops 32 and 34 are generally wedge-shaped with a perpendicular back edge 51*a* and 51*b* relative to the side-walls 60*a* and 60*b*. The waste collector stops 32 include a waste collector inclined face 52*b* and a waste collector back edge 51*b*. Dispenser stops 34 include a tissue dispenser inclined face 52*a* and tissue dispenser back edge 51*a*. The pair of dispenser stops 34 are each located on each outer side-wall 60*a*, proximate to said sliding face 22 of the dispenser 10. The pair of waste collector stops 32 are each located on each inner side-wall 60*b*, proximate to the front opening 30 of the waste collector 12. The inclined faces 52*a* and 52*b* of stops 34 and 32 respectively, travel to perpendicular back edges 51*a* and 51*b* relative to said outer sidewalls 60*a* and said internal side-walls 60*b*. The pair of dispenser stops 34 and the pair of waste collector 32 stops enable the dispenser 10 to remain attached to the waste collector 12 after such compacting. During attachment of the tissue dispenser 10 to the waste collector 12, stops 34 slide over stops 32 and dispenser inclined face 52*a* and waste collector inclined face 52*b* come into contact with each other. Finally, dispenser stops 34 slide completely over waste collector stops 32 and the attachment of the tissue dispenser 10 is made to the waste collector 12. As demonstrated in FIGS. 5 and 6, when the user tries to separate the two compartments 10 and 12, stops 32 and stops 34 catch on their respective back faces 51*b* and 51*a*, causing the two compartments to remain as one unit. Stops 32 and 34 can be made of plastic, metal, wood, rubber or any other suitable material.

In the method for storing and compacting tissues, using a dispenser 10 and a waste collector 12, the dispenser 10 holds tissues for removal by the user. The waste collector 12 houses used tissue waste paper 20. The user removes a tissue from the dispenser 10, uses the tissue, then disposes the tissue through the waste entryway 18 of the waste collector 12. When the waste collector fills, the user can compact the waste paper 20 by pushing the front face 26 of the dispenser 10 towards the back face 24 of the waste collector 12.

We claim:

1. A combination tissue dispenser and waste collector, comprising:

a hollow, generally rectangular dispenser having a top, a sliding face, and two opposing outer side-walls;

a hollow, generally rectangular waste collector having a top, a back face, a front opening and two internal side-walls, said dispenser being slidably engagable within said waste collector to enable the compacting of waste paper, using said sliding face;

a pair of dispenser stops, each said dispenser stop located on each said outer side-wall, proximate to said sliding face; and, a pair of waste collector stops, each said waste collector stop located on each said internal side-wall, proximate to said front opening, whereby said pair of dispenser stops and said pair of waste collector stops enable said dispenser to remain attached to said waste collector after such compacting.

2. The combination tissue dispenser and waste collector of claim 1, further comprising a flip cover attached to said dispenser top.

3. The combination tissue dispenser and waste collector of claim 2, further comprising a mirror attached to an underside of said flip cover.

4. The combination tissue dispenser and waste collector of claim 1, further comprising a waste entryway located on said waste collector top.

5. The combination tissue dispenser and waste collector of claim 1, wherein said stops further comprise an inclined face traveling to a perpendicular back edge relative to said outer side-walls and said inner side-walls.

6. A combination tissue dispenser and waste collector, comprising:

a hollow, generally rectangular dispenser having a top, a sliding face, and two opposing outer side-walls;

a hollow, generally rectangular waste collector having a top, a back face, a front opening and two internal side-walls, said dispenser being slidably engagable within said waste collector to enable the compacting of waste paper, using said sliding face;

a pair of dispenser stops, each said dispenser stop located on each said outer side-wall; proximate to said sliding face;

a pair of waste collector stops, each said waste collector stop located on each said inner side-wall, proximate to said front opening;

whereby said pair of dispenser stops and said pair of waste collector stops enable said dispenser to remain attached to said waste collector after such compacting;

a flip cover attached to said dispenser top; and, a mirror attached to an underside of said flip cover.

7. The combination tissue dispenser and waste collector of claim 6, further comprising a waste entryway located on said waste collector top.

8. The combination tissue dispenser and waste collector of claim 6, wherein said stops further comprise an inclined face traveling to a perpendicular back edge relative to said outer side-walls and said inner side-walls.

9. A combination tissue dispenser and waste collector, comprising:

a hollow, generally rectangular dispenser having a top, a sliding face, and two opposing outer side-walls;

a hollow, generally rectangular waste collector having a top, a back face, a front opening and two internal side-walls, said dispenser being slidably engagable within said waste collector to enable the compacting of waste paper, using said sliding face;

a pair of dispenser stops, each said dispenser stop located on each said outer side-wall; proximate to said sliding face;

a pair of waste collector stops, each said waste collector stop located on each said inner side-wall, proximate to said front opening; and, said pairs of stops further comprise an inclined face traveling to a perpendicular back edge relative to said outer side-walls and said inner side-walls, whereby said pair of dispenser stops and said pair of waste collector stops enable said dispenser to remain attached to said waste collector after such compacting.

10. The combination tissue dispenser and waste collector of claim 9, further comprising a flip cover attached to said dispenser top.

11. The combination tissue dispenser and waste collector of claim 10, further comprising a mirror attached to an underside of said flip cover.

12. The combination tissue dispenser and waste collector of claim 9, further comprising a waste entryway located on said waste collector top.

* * * * *